US006397831B1

(12) United States Patent
Plunger et al.

(10) Patent No.: US 6,397,831 B1
(45) Date of Patent: Jun. 4, 2002

(54) SAW FOR CUTTING OF HARD MATERIALS

(75) Inventors: Bernhard Plunger, St. Anton im Montafon; Michael Selb, Feldkirch; Josef Schittl, Thüringen, all of (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/573,021

(22) Filed: May 17, 2000

(30) Foreign Application Priority Data

May 17, 1999 (DE) ..... 199 22 086

(51) Int. Cl.[7] ..... B28D 1/04

(52) U.S. Cl. ..... 125/13.01; 125/16.03; 125/14

(58) Field of Search ..... 125/13.03, 16.03, 125/14, 16.01, 35, 30.01, 23.01

(56) References Cited

U.S. PATENT DOCUMENTS 3,323,507 A * 6/1967 Schuman ..... 125/13.01
4,192,282 A * 3/1980 Fischer ..... 125/23 T
5,545,079 A * 8/1996 Larsson et al. ..... 125/13.03
5,676,124 A * 10/1997 Lee ..... 125/13.01
5,746,193 A * 5/1998 Swan ..... 125/13.03
5,947,103 A * 9/1999 Saccon ..... 125/13.03
6,080,041 A * 6/2000 Greenland ..... 125/13.03
6,119,676 A * 9/2000 Greenland ..... 125/35

* cited by examiner

*Primary Examiner*—Joseph J. Hail, III
*Assistant Examiner*—Lee Wilson
(74) *Attorney, Agent, or Firm*—Sidley Austin Brown & Wood, LLP

(57) ABSTRACT

A saw for cutting hard materials, and including a guide rail (24) securable to a cut component, a support (13) displaceable along the guide rail (24), a saw head (1) including a drive for driving a saw blade, a guide element along which the saw head (1) is displaceable within predetermined limits and which is arranged on the support (13) and extends parallel to the drive shaft of the saw blade-driving drive and which extending transverse to a longitudinal extent of the guide rail (24) and transverse to the longitudinal extent of the guide rail (24), and a quick release device (5) provided between the support (13) and the saw head (1) for connecting the saw head (1) with the support (13).

9 Claims, 4 Drawing Sheets

SAW FOR CUTTING OF HARD MATERIALS

BACKGROUND OF THE INVENTION

1. Field of the Invention

The present invention relates to a saw for cutting hard materials and including a guide rail securable to a cut component, a support displaceable along the guide rail, a saw head having a drive for driving a saw blade and having a drive shaft extending transverse to a longitudinal extent of the guide rail, and a guide region along which the saw head is displaceable within predetermined limits and which is arranged on the support and extends parallel to the drive shaft of the drive and transverse to the longitudinal extent of the guide rail.

2. Description of the Prior Art

A German firm Demco Technic AG produces a saw known as "Piranha" for cutting hard materials such as stone and concrete. The saw has a guide rail, a support, and a saw head. The guide rail is secured to a cut component with suitable fastening elements. The support is mounted on the guide rail for displacement therealong. The support has a plate-shaped base having four guide rollers on one of its sides and supported on the guide rail. On the opposite side, the support is provided with a guide region for receiving and guiding the saw head. The guide region extends parallel to the sides of the base and transverse to the longitudinal extent of the guide rail. The guide region is formed by two, extending parallel to each other and spaced from each other, guide strips between which the receiving element of the saw head is displaceable. For displacing the saw head relative to the support and along the guide rail or in order to be able to lift the saw head off the support, it is necessary to loosen two screws with an appropriate tool and unscrew them out of the base. With this, one of the guide strips becomes disconnected from the base.

Because the screwing and unscrewing of the screws takes a lot of time and cannot be effected without the use of a suitable tool, generally, during the transportation of the saw, the saw head is not separated from the support and is transported therewith though the guide rail is transported separately. Because both the support and the saw head have large weight, the transportation of the saw is cumbersome and tedious.

Accordingly, the object of the present invention is to provide a saw for cutting hard materials the saw head of which can be lifted from a support quickly and easily without use of any special tools and can be easily displaced along the support and be secured thereto.

SUMMARY OF THE INVENTION

This and other objects of the present invention, which will become apparent hereinafter, are achieved by providing quick release means which are arranged between the saw head and the support for connecting the saw head with the support.

The provision of quick release means between the saw head and the support insured lifting of the saw head off the support with a simple handle, without the use of any special tool, and insured an easy displacement of the saw head along the support and attachment of the saw head to the support.

Advantageously, the quick release means includes a locking element arranged on the saw head for securing the saw head to the support, and a lever pivotally supported on the saw head for displacing the locking element parallel to the longitudinal extent of the guide rail against the guide element for the saw head.

With the use of such quick release means the receiving element of the saw head, which is located at the opposite end of the saw head, likewise cooperates with the guide region and is pressed sidewise against the guide region element, so that the guide region becomes clamped between the receiving element and the locking element.

For manufacturing reasons, preferably, the locking element is formed as a slide displaceable by a lever between open and closed positions. The slide can have, e.g., small dimensions, which permits to reduce the entire dimensions of the saw head.

For safety reasons, the saw according to the present invention has, advantageously, a locking pawl which cooperates with the lever and the guide region. Only in the open position of the slide, the locking pawl is able to freely rotate about an axle, which extends parallel to the drive shaft, out of the guide region. In the locking position of the slide, a protrusion, which is provided on the lever, cooperates with a locking surface of the locking pawl to prevent rotation of the locking pawl and to keep the locking pawl in a form-locking engagement with the guide region.

In order to insure that the locking pawl cooperates form-lockingly with the guide region only then when the saw head lies on the support, advantageously, the locking pawl is pivoted, against a spring-biasing force, into a position in which it is form-lockingly engaged in the guide region. The spring insures that, upon lifting the saw head of the support, the locking pawl immediately pivots, about its axle, away form the guide region, breaking the form-locking cooperation of the locking pawl with the guide region.

For displacing the saw head relative to the support along the guide rail, the slide is brought into an intermediate position located between the open and closed positions of the slide. In this position of the slide, the locking pawl form-lockingly cooperates with the guide region. With the lever preventing the pivotal movement of the locking pawl, the saw head can be displaced relative to the support along the guide rail.

In order to insure a reliable attachment of the support by a saw operator and to be able, if needed, to transport the support together with the guide rail, which is secured, e.g., on the support against displacement, the support includes preferably a plate-shaped base having, in a region extending sidewise of the guide rail, a large opening.

In order to be able to fasten with two hands, advantageously, the support base is provided with two opposite regions extending on opposite sides of the guide rail, with each region having a large opening.

For an easy alignment of the guide rail, during mounting of the saw, along horizontal and/or vertical lines, advantageously, the support is provided with at least one indication element which shows an inclination of the support of the guide rail to the horizontal or vertical line.

Preferably, the support has a marking which shows the offset of the saw head with respect to the support along the guide rail. This marking also permits, e.g., an exact determination of a distance between two supports extending parallel to each other.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
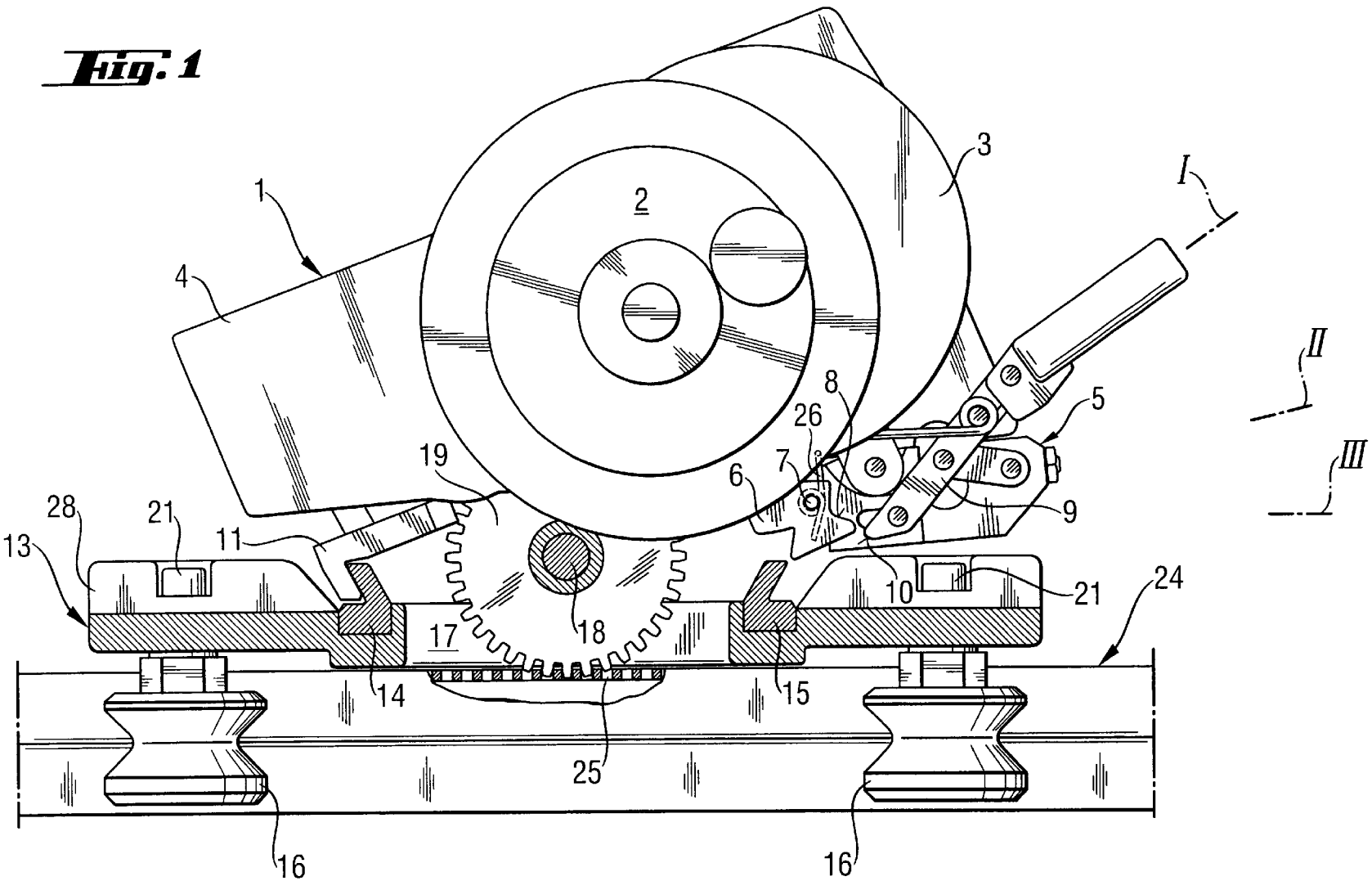
FIG. 1 a side view of a saw according to the present invention with a guide rail, a support, and a saw head in an opening position of a slide which mounts the saw head on the support.
Figure 2:
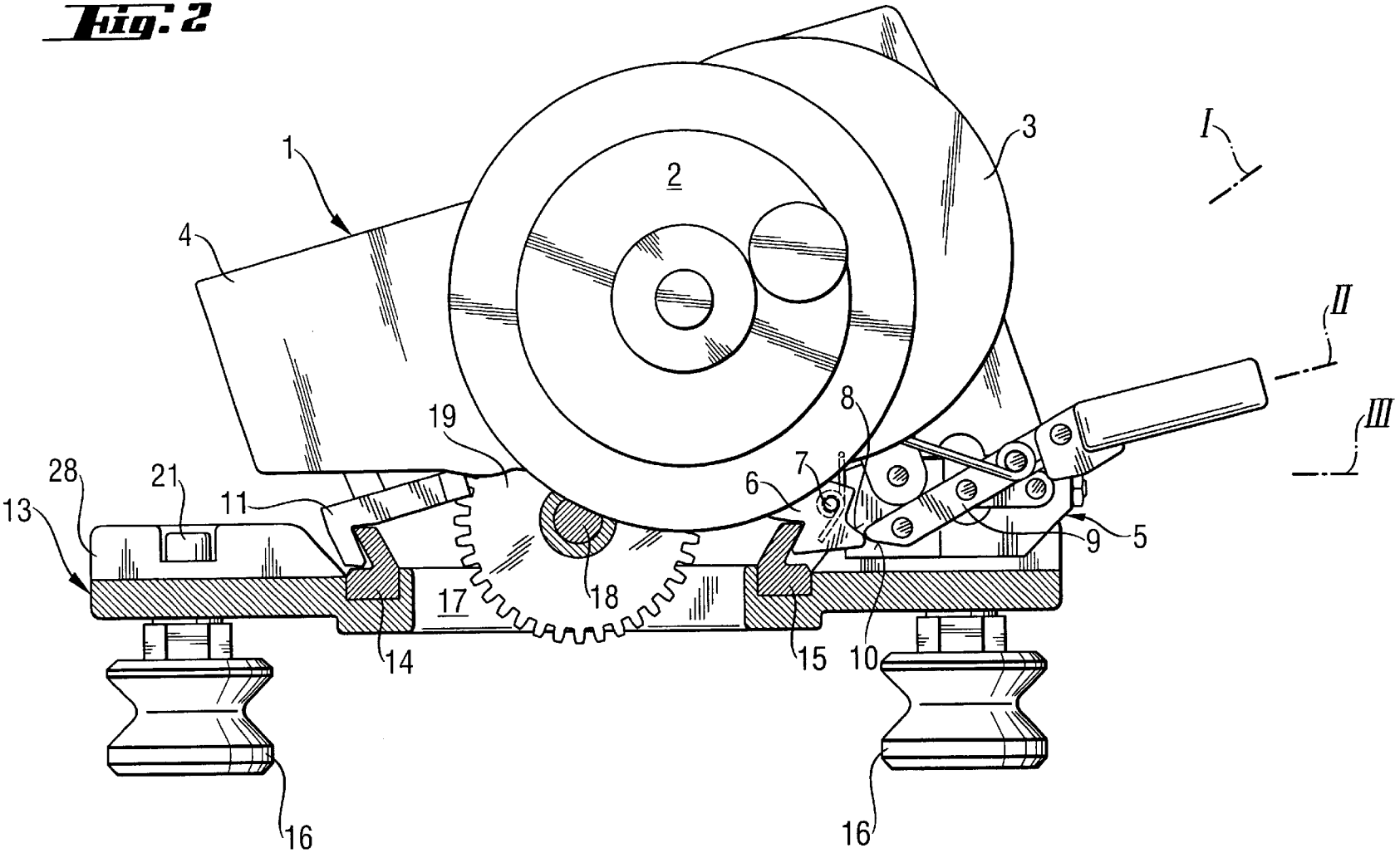
FIG. 2 a side view of the saw shown in FIG. 1 but without the guide rail and with the slide in an intermediate position.
Figure 3:
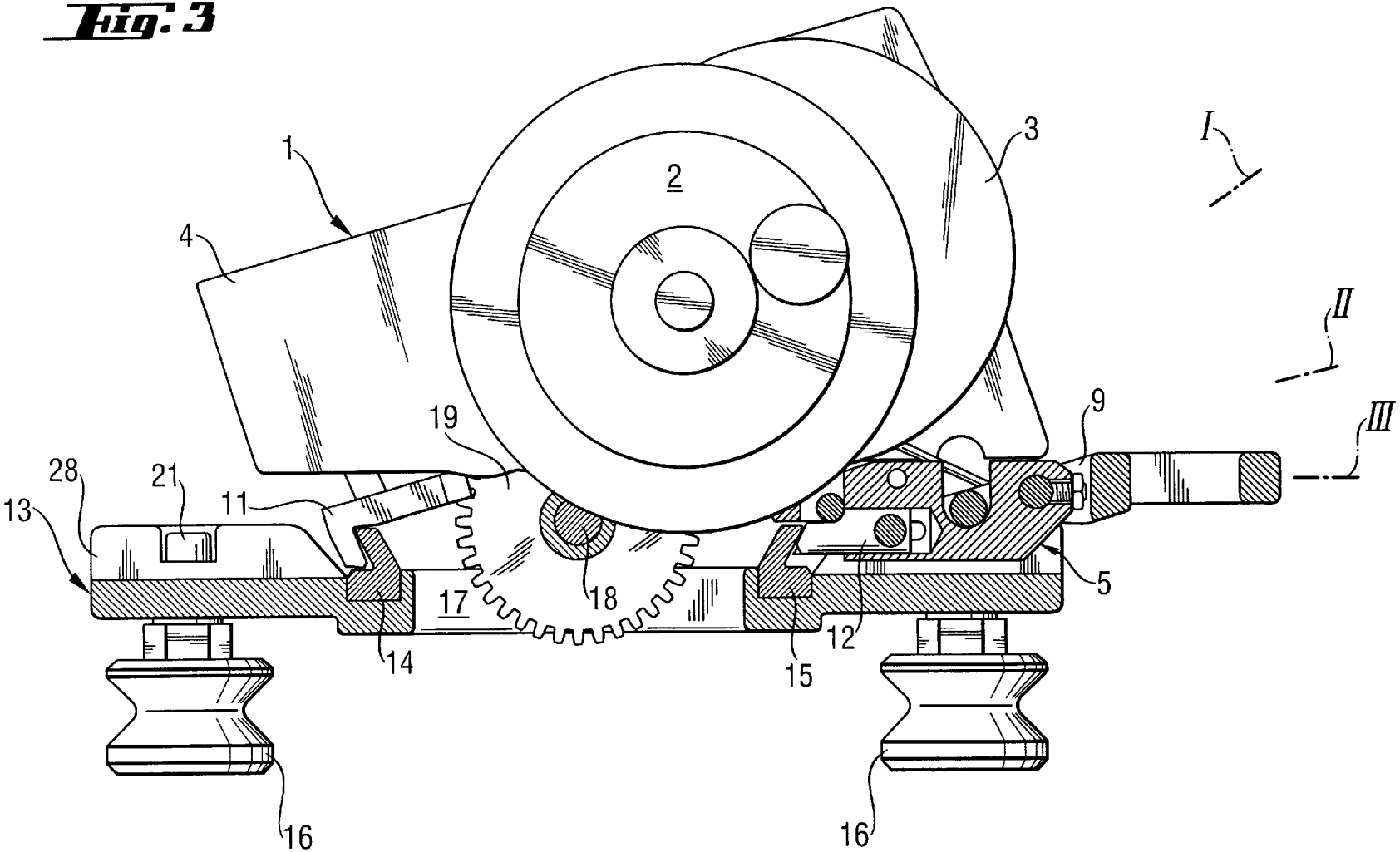
FIG. 3 a side view of the saw shown in FIG. 1 without the guide rail and with the slide in a locking position.

A saw according to the present invention, which is shown in the figures, is used for cutting hard materials such as concrete or stone and includes, as shown in FIGS. 1–3, a guide rail 24, a support 13 displaceable along the guide rail 24, and a saw head 1 mounted on the support 13.

The guide rail 24, which is shown only in FIG. 1, has a substantially tubular shape and a rectangular cross-section. Convex, outwardly extending guide surfaces are provided on both wide sides of the guide rail 24. Between these guide surfaces, the guide rail 24 is provided, on one of its longitudinal sides, with a section 25 formed of a plurality of elongate holes which extend transverse to the longitudinal extent of the guide rail 24 in a spaced relationship to each other. Both the guide surfaces provided on wide sides of the guide rail 24 and the section 25 on the longitudinal side of the guide rail 24 extend over the entire length of the guide rail 24. The guide rail 24 is supported on a surface of a to-be-processed constructional component (not shown) by fastening elements (likewise not shown) in a spaced relationship to the constructional component.

The support 13, which is displaced along the guide rail 24, has a base 28 with a substantially rectangular base surface. In each of its four comers, the support 13 is provided with a guide roller 16 connected with the base 28 in a spaced relationship thereto. The contact surface of the guide rollers 16 corresponds to a concave recess formed in the guide surface of the guide rail 24. The rollers 16 are connected with the base 28 by attachment elements 21, e.g., screws which extend through the base.

On its side opposite to the side to which the guide rollers 16 are attached, the base 28 of the support 13 has a guide region that extends transverse to the longitudinal extent of the guide rail 24 and parallel to this opposite side. This guide region is formed of two, parallel to each other and spaced from each other, guide strips 14, 15 secured to the base 28 of the support 13. Both guide strips 14 and 15 have working surfaces adjacent to the opposite side of the base 28 and extending at an acute angle to the base 28.

The base 28 has, in its central region between the guide strips 14 and 15, a slot-shaped through-opening 17 extending parallel to the longitudinal extent of the guide rail 24. A pinion 19 rotatable about a rotational axle 18, which is supported on the support 13, extends transverse to the longitudinal extent of the guide rail 24 and parallel to the opposite surface of the base 28, extends through the through-opening 17. The teeth of the pinion 19 engage form-lockingly into the section 25.

Figure 4:
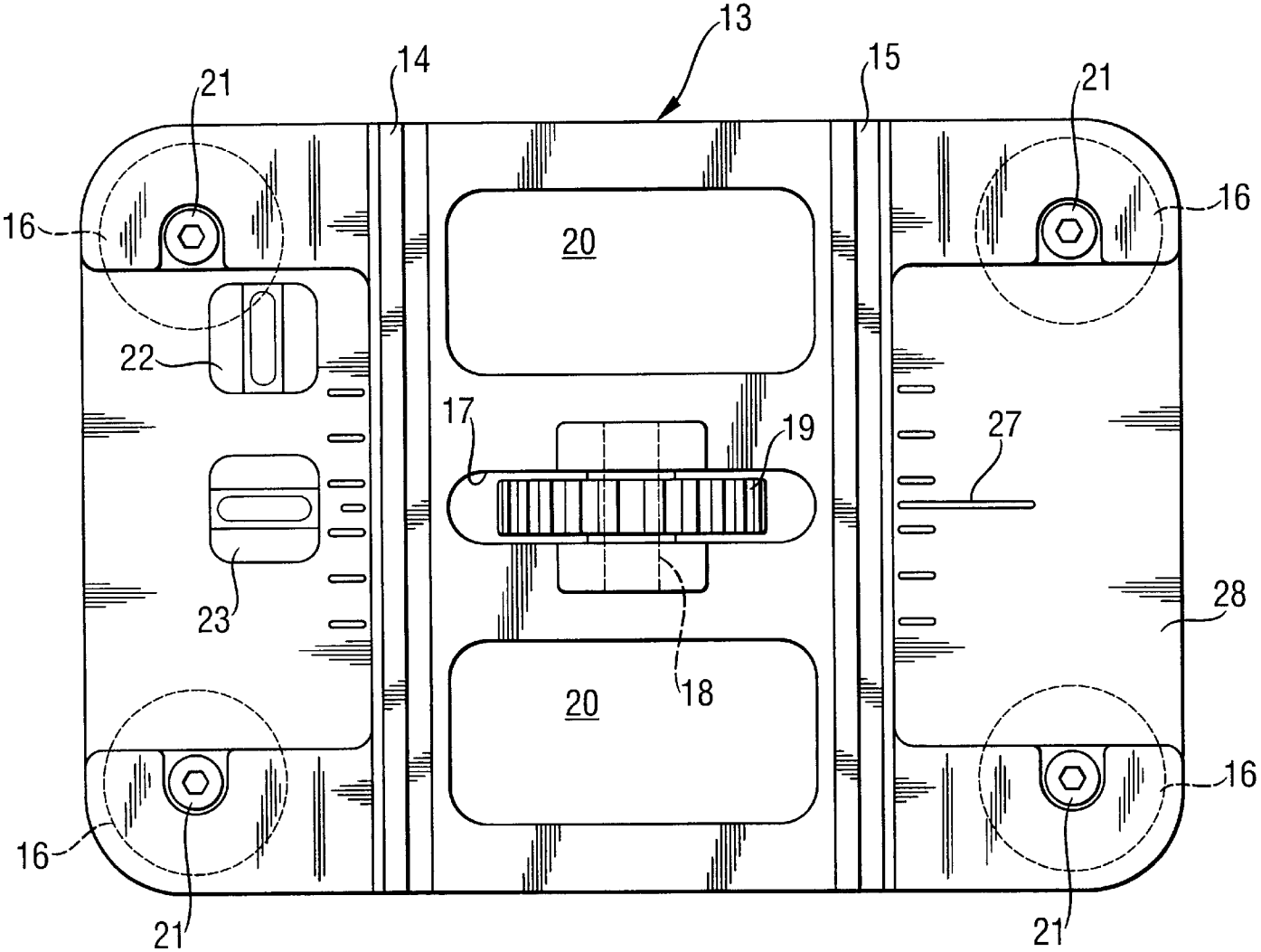
FIG. 4 a plan view of the support.

Adjacent to the pinion 19, the base 28 has, as shown in FIG. 4, a large opening 20 a longer extend of which runs parallel to the longitudinal extent of the guide rail 24. Two indication elements 22, 23, which are formed as bubble levels, are connected with the base 28. The indication elements 22, 23 show the inclination of the support 13 or the guide rail 24 to a horizontal or a vertical.

The saw head 1, which is shown in FIGS. 1–3, has a housing 4, a drive motor 3, which, e.g., can be hydraulically driven, a hub flange 2 connected with the drive shaft of the drive motor 3, and quick release means 5. The receiving element 11 and the quick release means 5 cooperate with guide strips 14 and 15 of the support 13.

The receiving element 11 is formed as a strip adapted to a guide strip 14 of the guide region of the support 13. The quick release means 5 is formed as a slide 12 displaceable, upon actuation of a lever 9 pivotally arranged on the saw head 1, parallel to the longitudinal extent of the guide rail 14, against the guide region formed by the guide strip 15 for securing the saw head I on the support 13. The slide 12 is displaceable, between an open position (I), a closed position (III), and an intermediate position (II) located between the open and closed positions (I and II), as shown in FIG. 1.

A locking pawl 6, which cooperates with the lever 9 and engages in the guide region formed by the guide strip 15, is arranged on the saw head 1. The pawl 6 rotates about an axle 7, which extends parallel to the longitudinal axis of the drive shaft, against a biasing force of a spring 26.

As shown in FIG. 1, the receiving element 11 and the guide region, which is formed by the guide strip 14, form-lockingly engage each other. In the region of the second guide strip 15, the saw head 1 is spaced from the support 13. The slide 12 (not visible in FIG. 1) and a lever 9, which cooperates with the slide 12, are located in the open position (I). The locking pawl is in its initial position. The lever 9 has, at its end adjacent to the locking pawl 6, a locking protrusion 10 which does not cooperate with a locking surface 8 of the locking pawl 6 in the open position (I). Therefore, the locking pawl 6 can freely rotate against the biasing force of the spring 26.

FIG. 2 shows the intermediate position (II) of the lever 9 and the slide 12, not visible in FIG. 2, in which the saw head 1 is supported completely on the support 13. In the position of the saw head 1, in which the saw head 1 is completely supported on the support 13, the locking pawl 6, after having been pivoted against the biasing force of the spring 26, form-lockingly engages the guide ship 15. Also in this position of the saw head, the locking protrusion 10 of the lever 9 form-lockingly engages the locking surface 8 of the locking pawl 6, which prevents the pivotal movement of the locking pawl 6 in its initial position under the action of the biasing force of the spring 26. In the intermediate position (II), the saw head 1 is displaceable along the guide region which is formed by the guide strips 14 and 15.

FIG. 3 shows the lever 9 and the slide 12 in the locking position (III). In this position both the receiving element 11 and the slide 12 engage, with a preload, the guide strips 14 and 15, respectively, and the saw head I is fixedly connected with the support 13.

As it has already been discussed, two indication elements 22, 23 are arranged on the base 28 of the support 13, as shown in FIG. 4. The indication elements 22, 23 show the inclination of the support 13 or the guide rail 24 to horizontal and vertical lines. Marking 27, which can be formed, e.g., as a measuring scale and which is provided on the base 28, shows the amount of offset of the saw head 1 relative to the base 28 of the support 13.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A saw for cutting hard materials, comprising a guide rail (24) securable to a cut workpiece; a support (13) displaceable along the guide rail (24); a saw head (1) including drive means for driving a saw blade and having a drive shaft extending transverse to a longitudinal extent of the guide rail (24); guide means along which the saw head (1) is displaceable within predetermined limits and which is arranged on the support (13) and extends parallel to the drive shaft of the saw blade-driving drive means and transverse to the longitudinal extent of the guide rail (24); and quick release means (5) provided between the support (13) and the saw head (1) for connecting the saw head (1) with the support (13), wherein the quick release means (5) comprises a locking element arranged on the saw head (1) for securing the saw head (1) to the support (13); and a lever (9) pivotally supported on the saw head (1) for displacing the locking element parallel to the longitudinal extent of the guide rail (24) against the guide means.

2. A saw according to claim 1, wherein the locking element is formed as a slide (12) displaceable between at least one open (I) and closed (III) positions.

3. A saw according to claim 2, further comprising a locking pawl (6) arranged on the saw head (1), cooperating with the guide means and the lever (9), and freely rotatable about an axle (7), which extends parallel to the drive shaft of the saw blade-driving drive means, and out of the guide means only in the open position (I) of the slide (12).

4. A saw according to claim 3, wherein the quick release means (5) comprises a spring (26) for biasing the locking pawl (6) out of the guide means, the locking pawl (6) being pivotable in a form-locking engagement with the guide means against the biasing force of the spring (26).

5. A saw according to claim 3, wherein the slide (12) has an intermediate position (II) in which the locking pawl form-lockingly cooperates with the guide means and is being prevented from being pivoted about the axle (7) by the lever (9), and in which the saw head (1) is displaceable along the guide means relative to the support (13).

6. A saw for cutting hard materials, comprising a guide rail (24) securable to a cut workpiece; a support (13) displaceable along the guide rail (24); a saw head (1) including drive means for driving a saw blade and having a drive shaft extending transverse to a longitudinal extent of the guide rail (24); guide means along which the saw head (1) is displaceable within predetermined limits and which is arranged on the support (13) and extends parallel to the drive shaft of the saw blade-driving drive means and transverse to the longitudinal extent of the guide rail (24); and quick release means (5) provided between the support (13) and the saw head (1) for connecting the saw head (1) with the support (13), wherein the support (13) has a plate-shaped base (28) having, in a region extending sidewise of the guide rail (24), at least one large opening (20).

7. A saw according to claim 6, wherein the support base (13) has two opposite regions extending sidewise of the guide rail (24) and having each a large opening (20).

8. A saw for cutting hard materials, comprising a guide rail (24) securable to a cut workpiece; a support (13) displaceable along the guide rail (24); a saw head (1) including drive means for driving a saw blade and having a drive shaft extending transverse to a longitudinal extent of the guide rail (24); guide means along which the saw head (1) is displaceable within predetermined limits and which is arranged on the support (13) and extends parallel to the drive shaft of the saw blade-driving drive means and transverse to the longitudinal extent of the guide rail (24); and quick release means (5) provided between the support (13) and the saw head (1) for connecting the saw head (1) with the support (13), wherein the support (13) has at least two indication elements (22, 23) which show an inclination of the support (13) and the guide rail (24) relative to horizontal and vertical lines, respectively.

9. A saw for cutting hard materials, comprising a guide rail (24) securable to a cut workpiece; a support (13) displaceable along the guide rail (24); a saw head (1) including drive means for driving a saw blade and having a drive shaft extending transverse to a longitudinal extent of the guide rail (24); guide means along which the saw head (1) is displaceable within predetermined limits and which is arranged on the support (13) and extends parallel to the drive shaft of the saw blade-driving drive means and transverse to the longitudinal extent of the guide rail (24); and quick release means (5) provided between the support (13) and the saw head (1) for connecting the saw head (1) with the support (13), wherein the support has a marking (27) which shows an offset of the saw head (1) with respect to the support (13) along the guide means.

* * * * *